US011402111B2

(12) United States Patent
Vogel

(10) Patent No.: US 11,402,111 B2
(45) Date of Patent: Aug. 2, 2022

(54) STAGED DAMPER SYSTEM

(71) Applicant: Air Distribution Technologies IP, LLC, Milwaukee, WI (US)

(72) Inventor: Timothy A. Vogel, Grandview, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 990 days.

(21) Appl. No.: 15/713,429

(22) Filed: Sep. 22, 2017

(65) Prior Publication Data

US 2018/0119970 A1 May 3, 2018

Related U.S. Application Data

(60) Provisional application No. 62/417,165, filed on Nov. 3, 2016.

(51) Int. Cl.

| | |
|---|---|
| ***F24F 11/00*** | (2018.01) |
| ***F24F 13/10*** | (2006.01) |
| ***F24F 13/14*** | (2006.01) |

(52) U.S. Cl.

CPC ..... *F24F 11/0001* (2013.01); *F24F 13/10* (2013.01); *F24F 13/14* (2013.01); *F24F 13/1426* (2013.01)

(58) Field of Classification Search

CPC ..... F24F 11/0001; F24F 13/00; F24F 13/14; F24F 1/1426

USPC ..... 454/370, 264; 137/630

See application file for complete search history.

(56) References Cited

U.S. PATENT DOCUMENTS

| | | | | |
|---|---|---|---|---|
| 1,928,577 | A * | 9/1933 | Tarone | F23L 13/00 126/285 R |
| 4,249,883 | A * | 2/1981 | Woolfolk | F23N 3/085 431/20 |
| 4,251,024 | A * | 2/1981 | Feinberg | F23L 11/005 126/285 B |
| 4,553,695 | A * | 11/1985 | Grant | F23N 3/045 236/9 A |
| 5,158,328 | A | 10/1992 | Anderson et al. | |
| 5,533,549 | A | 7/1996 | Sherman | |

(Continued)

FOREIGN PATENT DOCUMENTS

| | | |
|---|---|---|
| EP | 0924475 A1 | 6/1999 |

OTHER PUBLICATIONS

American Aides Corp., "CAR-II-HP Product Specifications and Technical Data", Sep. 16, 2016, pp. 1-2, Web. <https://web.archive.org/web/20160910092737/http://www.aldes.us:80/images/products/specs/car-ii-hp_spec.pdf> (Year: 2016).*

(Continued)

*Primary Examiner* — Allen R. B. Schult

(74) *Attorney, Agent, or Firm* — Fletcher Yoder, P.C.

(57) ABSTRACT

A damper system includes a damper housing configured to flow air, a damper blade disposed in the damper housing and having an orifice, the damper blade being rotatable in the damper housing between a closed position and an open position. The orifice is configured to allow air to flow through the damper blade while the damper blade is in the closed position. An auto-balancing damper is disposed in the damper housing apart from the damper blade, and the auto-balancing damper is configured to regulate a flow of the air through the damper housing.

23 Claims, 11 Drawing Sheets

(56) References Cited

U.S. PATENT DOCUMENTS

| | | | | |
|---|---|---|---|---|
| 6,234,208 | B1 * | 5/2001 | Magdelyns | F02D 9/101 123/337 |
| 6,514,138 | B2 | 2/2003 | Estepp | |
| 6,916,239 | B2 | 7/2005 | Siddaramanna et al. | |
| 7,758,407 | B2 | 7/2010 | Ahmed | |
| 7,765,981 | B2 * | 8/2010 | Lhote | F02D 9/06 123/323 |
| 7,766,734 | B2 | 8/2010 | Dietz et al. | |
| 8,515,584 | B2 | 8/2013 | Miller et al. | |
| 9,201,428 | B2 | 12/2015 | Dietz et al. | |
| 9,759,442 | B2 * | 9/2017 | Dietz | G05D 7/0658 |
| 10,203,703 | B2 * | 2/2019 | Ashton | F24F 13/1426 |
| 2009/0088067 | A1 | 4/2009 | Rimmer et al. | |
| 2009/0280737 | A1 * | 11/2009 | Jacak | F24F 11/745 454/358 |
| 2011/0275735 | A1 | 11/2011 | Robbins et al. | |
| 2012/0072030 | A1 | 3/2012 | Elliott | |
| 2013/0337736 | A1 | 12/2013 | Marak et al. | |
| 2014/0065939 | A1 | 3/2014 | Dietz et al. | |
| 2015/0253781 | A1 * | 9/2015 | Ashton | F24F 11/75 454/256 |
| 2016/0076784 | A1 | 3/2016 | Dietz et al. | |

OTHER PUBLICATIONS

Automatic Airflow Balancing, "Automatic Balancing Valve—Product Specification ABV1.0-0414," Apr. 2014, 2 Pages.
Siemens Industry, Inc., "Venturi Air Valve or Single-Blade Damper," Sep. 2008, Document No. 149-985, 8 pages.
Trox Technik, "Volume Flow Limiters—Type VFL," Apr. 2014, 12 pages.

* cited by examiner

STAGED DAMPER SYSTEM

CROSS REFERENCE TO RELATED APPLICATIONS

This application claims priority to and the benefit of U.S. Provisional Application Ser. No. 62/417,165, entitled "Two-stage Automatic Balancing Damper," filed Nov. 3, 2016, which is hereby incorporated by reference in its entirety for all purposes.

BACKGROUND

The present disclosure relates to heating, ventilating, air conditioning, and refrigeration (HVAC&R) systems, and specifically, to a ventilation damper system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an airflow delivered to and ventilated from the environment. For example, a heating, ventilating, and air conditioning (HVAC) system routes the airflow through ductwork. The HVAC system may be placed within a home, office, hospital, or any other building. As such, the ductwork may be connected to different rooms, where it may replace air in the rooms. In some cases, the amount of air flowing through a room and thus the amount of energy used to ventilate the room is the same, regardless of whether the room is vacant or occupied.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment a damper system includes a damper housing configured to flow air; a damper blade disposed in the damper housing and having an orifice, wherein the damper blade is rotatable in the damper housing between a closed position and an open position, and wherein the orifice is configured to allow air to flow through the damper blade while the damper blade is in the closed position; and an auto-balancing damper disposed in the damper housing apart from the damper blade, wherein the auto-balancing damper is configured to regulate a flow of the air through the damper housing.

In another embodiment, a damper system includes a damper housing configured to flow ventilation air through a first stage and a second stage of the damper system, wherein the first stage is configured to allow turndown of a flow rate of the ventilation air, and wherein the second stage is configured to maintain a setpoint for the flow rate of the ventilation air and is disposed downstream of the first stage; a damper blade of the first stage disposed in the damper housing and having an orifice, wherein the damper blade is rotatable in the damper housing via a shaft extending through the damper housing to switch between a closed position and an open position, and wherein the orifice is configured to allow air to flow through the damper blade while the damper blade is in the closed position; and an actuator physically coupled to the damper blade via the shaft and configured to rotate the damper blade between the closed position and the open position, and wherein the actuator, in response to receiving a power supply, is configured to adjust the damper blade to the open position.

In another embodiment, a damper system includes a housing configured to flow ventilation air through a first stage and a second stage of the damper system, wherein the first stage is configured to allow turndown of a flow rate of the ventilation air. The second stage is configured to maintain a setpoint for the flow rate of the ventilation air and is disposed downstream of the first stage. The system also includes a damper blade of the first stage disposed in the damper housing and having an orifice, wherein the damper blade is rotatable in the damper housing via a shaft extending through the damper housing to switch between a closed position and an open position, and wherein the orifice is configured to allow air to flow through the damper blade while the damper blade is in the closed position; and an orifice adjusting element positioned on the damper blade and proximate the orifice, wherein the orifice adjusting element is configured to rotate on the damper blade to cover all or a portion of the orifice to control the amount of air flowing through the orifice.

DRAWINGS

Various aspects of this disclosure may be better understood upon reading the following detailed description and upon reference to the drawings in which.

DETAILED DESCRIPTION

Figure 1:
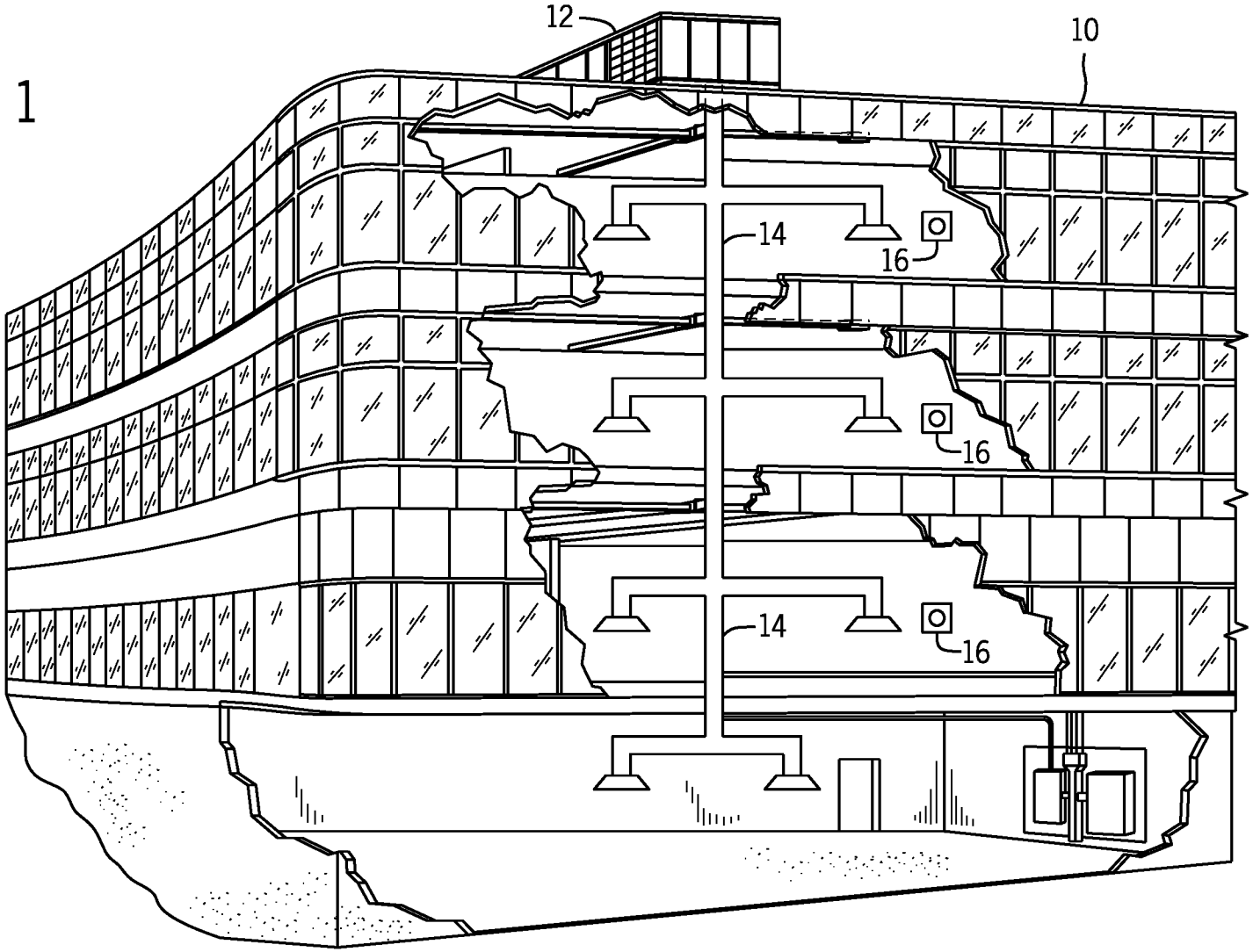
FIG. 1 is a schematic of an environmental control for building environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to heating, ventilating, and air conditioning (HVAC) systems that use ductwork to provide air flow through different rooms. The ductwork may include a main air duct connected to an HVAC unit that processes air. The main air duct is generally fluidly connected to several branches that connect to different rooms. Certain ductwork may be used for delivery of conditioned air to the rooms, while other ductwork may be used for returning air to the air conditioning units associated with the HVAC system or for ventilating air from certain rooms to the outside environment. Thus, within each individual room, the corresponding air duct (or ducts) may extract air out of the room, deliver air to the room, or any combination thereof. Thus, the ductwork associated with each room is generally used to control air flow through the room. Traditionally, the amount of air flowing through each room is the same, regardless of whether the room is occupied or vacant. This can introduce unnecessary costs associated with maintaining a conditioned state of the air within the room.

Generally, air flow, including air ventilation out of a room, may be governed by various standards. This leads to various building and manufacturing standards that establish minimum ventilation requirements for a given conditioned area. Certain ventilation systems, for instance, are responsive to changes in air flow. For example, such ventilation systems may balance the air flow in a room in response to changes resulting from a flow of conditioned air being introduced into a room associated with the ventilation system. However, this generally happens regardless of the occupancy of a room, and generally far exceeds the minimum ventilation requirements for a given conditioned space.

In accordance with certain embodiments of the present disclosure, it is now recognized that turning down the amount of air ventilating out of a room may enhance the efficiency of systems configured to condition the air of various spaces. That is, it is presently recognized that the amount of ventilated air flow out of a room can be turned down, which results in a reduced load on HVAC systems that would otherwise have to re-condition new air to replace the excess air ventilated from the room.

Embodiments of the present disclosure include a multi-stage damper system (e.g., a two-stage damper system, or staged damper system) that may be integrated into the respective air ventilation ducts for ventilating a given room. The staged damper system causes different amounts of air flow to be ventilated through the air ventilation duct, for example in response to an indication of room occupancy.

For example, a first state (e.g., an uncontrolled or default state) of the staged damper system may limit an amount of air flow that is able to be ventilated from a given space. The limited amount may be greater than no air flow, but substantially less than a full level of air flow that is able to be ventilated from the space by the staged damper system. As an example, the amount of air flow allowed to ventilate in the first state of the staged damper system may be enough to satisfy certain indoor air quality standards, but less than typically ventilated using, for example, traditional damper systems. In certain embodiments, a first stage of the staged damper system, which includes a first damper, performs the function of limiting the airflow, while a second stage of the staged damper system, which includes, by way of example, an automatic balancing damper (ABD), balances airflow at levels at or below the airflow limit established by the first stage. In accordance with certain embodiments, the first state of the staged damper system is maintained while the conditioned space is unoccupied.

While the first state of the staged damper system limits airflow via the first stage of the staged ventilation system, a second state of the system does not substantially limit airflow using the first stage. Instead, airflow through the staged damper system is balanced by the second stage of the staged damper system. Accordingly, in the second state of the staged damper system, airflow is balanced by the second stage at or below the airflow limit of the staged damper system itself (which is substantially higher than the airflow limit established by the first stage in the first state). Stated differently, in the second state, the first damper may be considered "fully open."

Transitioning between the first and second states of the staged damper system may be accomplished in various ways, as described below. As an example, when there is indication that a conditioned room is occupied (e.g. a light switch is turned on), the system may increase the amount of air that can flow through the room by energizing an actuator that causes the first stage to fully open. Conversely, the system may decrease the amount of air flowing through the room in response to an indication that the conditioned room is not occupied, for example by de-energizing the actuator and allowing a spring force to return the first stage to a substantially closed state (the first stage is considered "substantially closed" because a certain airflow is always allowed by the first stage).

The staged damper systems described herein may be integrated into any number of different types of ducts, and is not necessarily limited to ducts associated with air ventilation. For example, the staged damper systems described herein may be used in ducts associated with conditioned air delivery. However, it should be noted that the staged damper systems may be particularly useful in enabling ventilation airflow turndown, as described herein. Further, the staged damper systems described herein may be used in association with any number of HVAC systems, including those in residential and commercial settings. Non-limiting examples of systems that may use the staged damper systems of the present disclosure are described herein with respect to FIGS. 1-4.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
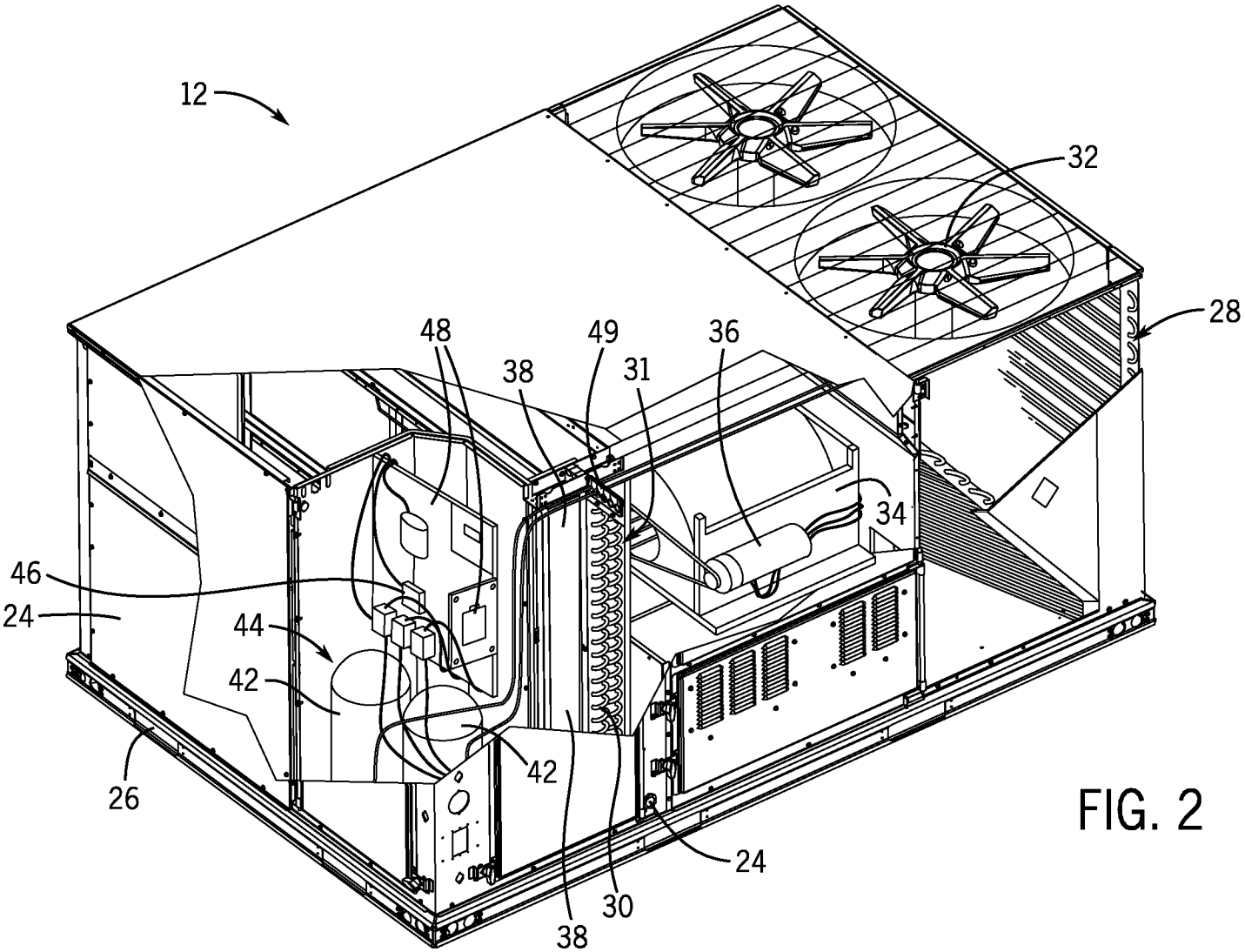
FIG. 2 is a perspective view of an embodiment of the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
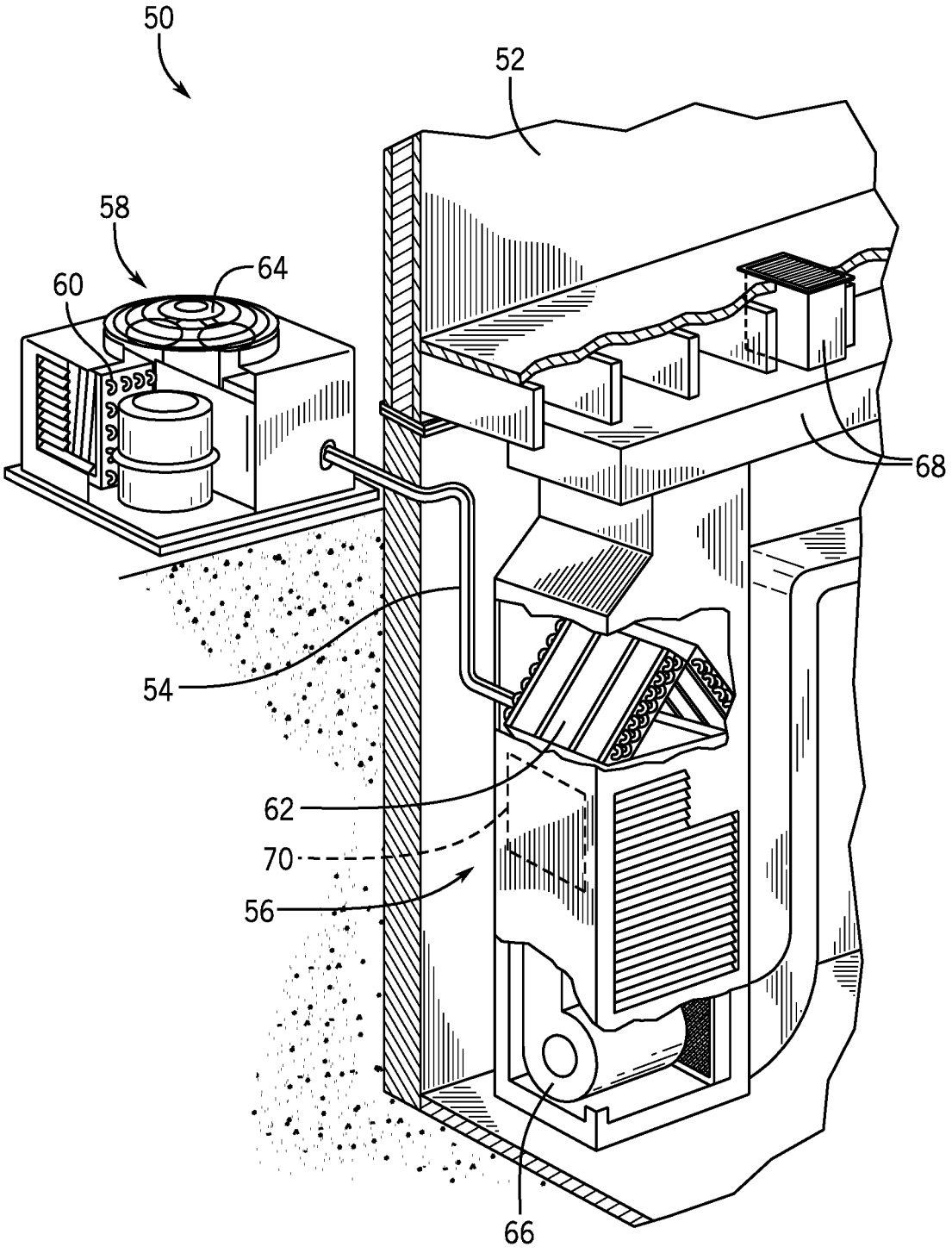
FIG. 3 is a schematic of a residential heating and cooling system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
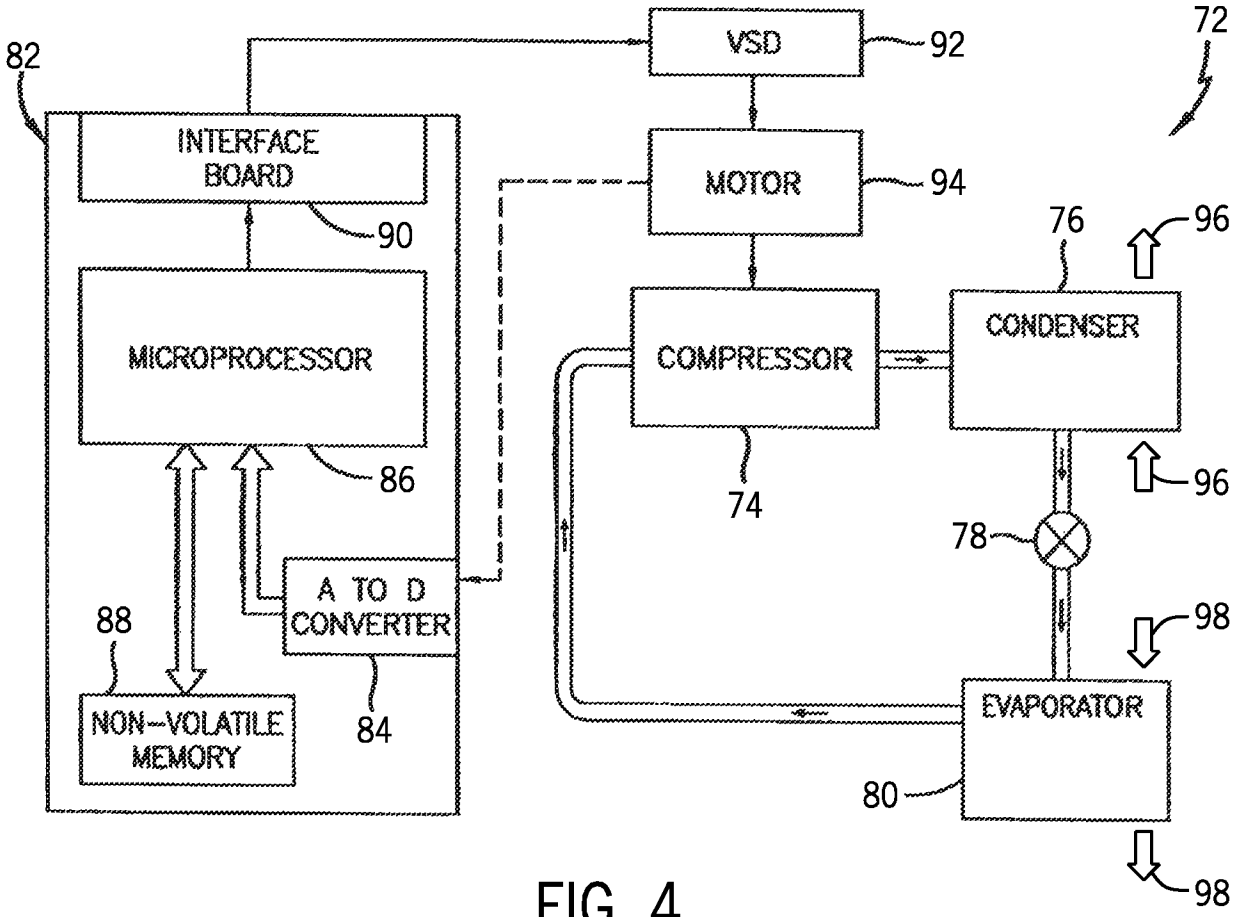
FIG. 4 is a schematic of an embodiment of a vapor compression system that can be used in any of the systems of FIGS. 1-3, in accordance with an aspect the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, conditioned air may be provided to and ventilated from conditioned air spaces via, for example, ductwork 14 of FIG. 1 and ductwork 68 of FIG. 3. This ductwork may branch to individual air ducts leading into each room of a building. Further, other ductwork may be configured for only ventilation, such as ducts associated with ventilation fans in a restroom. In accordance with present embodiments, certain of these ducts may include a staged damper system that varies the amount of air flowing through a room depending on if the room is vacant or occupied. For example, the first stage may include a damper blade that can close the air duct during room vacancy to block most air flow. The damper blade may include an orifice that allows a certain amount of air flow to satisfy minimum ventilation standards. During room occupancy, the damper blade may open up to allow for full air flow through the air duct. The second stage may include an automatic balancing damper (ABD) that adjusts the amount of air flow to a suitable amount when a room is occupied. In some embodiments, the suitable amount may depend on air flow speed, user input, or any combination thereof. Thus, the system changes the air flow to correspond to room occupancy.

Figure 5:
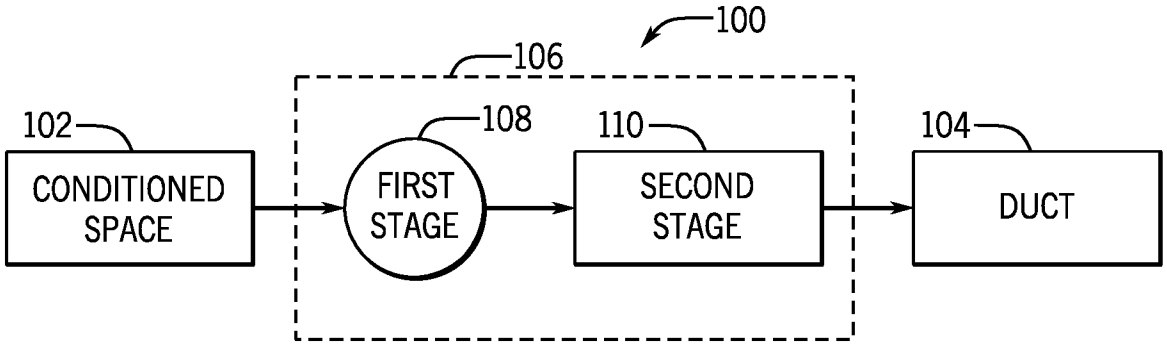
FIG. 5 is a schematic view of an embodiment of a staged damper system integrated into a ventilation system, in accordance with an aspect the present disclosure.

FIG. 5 schematically illustrates an embodiment of the manner in which a staged damper system 100 of the present disclosure may be integrated into the systems noted above. In the illustrated embodiment, the staged damper system 100 is situated fluidly between a conditioned space 102, such as a room, restroom, etc., and a duct 104. The duct 104, may be a part of the HVAC systems noted above, or may simply lead to the outside environment. Other features may be positioned between the staged damper system 100 and the conditioned space 102, such as a fan, a vent, a vent cover, a duct, and so forth. Indeed, in certain implementations, the staged damper system 100 may be attached at both ends (e.g., an inlet end and an outlet end) to a respective duct.

During operation, air will first flow from the conditioned space 102 and into the staged damper system 100 (e.g., via an air vent, a vent fan, a vent duct, or the like). As described in further detail below with respect to FIG. 7, the staged damper system 100 may include a housing 106 that encloses a first stage 108 and a second stage 110 of the staged damper system 100. By way of example, the housing 106 may be situated within the duct 104, or situated between portions of the duct 104 (e.g., connecting portions of the duct 104).

The first stage 108 may be responsive to room occupancy, and is generally configured to turn down the amount of ventilation air that is able to flow from the conditioned space 102. For example, the first stage 108 may be configured to restrict ventilation air flow from the conditioned space 102 while in a first state (e.g., corresponding to the conditioned space 102 being vacant), and is configured to allow substantially unrestricted ventilation air flow from the conditioned space 102 while in a second state (e.g., corresponding to the conditioned space 102 being occupied).

After passing first stage 108, the air will pass through a second stage 110 of the staged damper system 100. The second stage 110 of the staged damper system 100 is configured to balance the air flowing through the staged damper system 100 in both the first and second states of the first stage 108. In certain embodiments, for example, the second stage 110 includes an automatic balancing damper (ABD) configured to regulate an amount of air flowing through the staged damper system 100. After passing through the second stage 110, the air will enter the duct 104, where it may be directed back to the HVAC system, or to the outside environment.

Although this embodiment shows the air starting in conditioned space 102 and ending in the duct 104, another embodiment may direct the air from the HVAC system (e.g., from the duct 104) to the conditioned space 102. Furthermore, although this embodiment illustrates has the first stage 108 being responsible for the turn down of ventilation air and the second stage 110 as being responsible for air flow balancing, in other embodiments, the second stage 110 may be configured to turn down ventilation air flow and the first stage 108 may be configured to balance air flow. For instance, in certain embodiments the first stage 108 may include the ABD as described herein, and the second stage 110 may include the damper blade as described herein. In such embodiments, the ABD is upstream of the damper blade.

Figure 6:
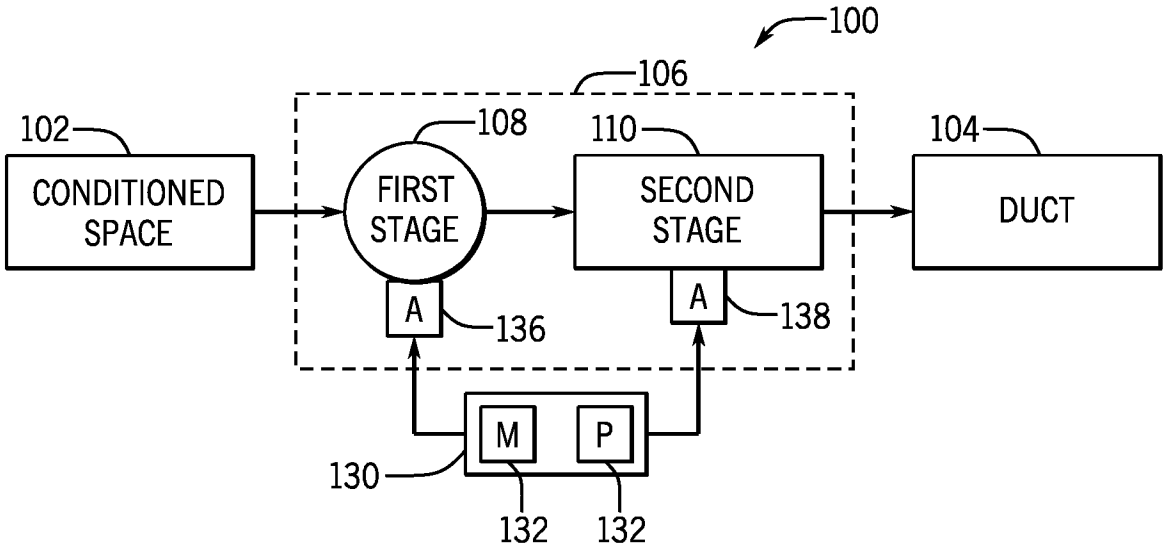
FIG. 6 is a schematic view of an embodiment of the staged damper system of FIG. 5 associated with a controller, in accordance with an aspect the present disclosure.

FIG. 6 illustrates another embodiment of the staged damper system 100 in which the staged damper system 100 includes or is associated with a controller 130 configured to control the operation of the first stage 108, the second stage 110, or any combination thereof. The controller 130 may be located within the housing 106, may be attached to the housing 106, or may be located remotely relative to the housing 106 to allow for servicing and so forth. The controller 130 may include a memory 132 with stored instructions for controlling either or both of the first stage 108 and the second stage 110, and a processor 134 configured to execute such instructions. For example, the processor 134 may include one or more application specific integrated circuits (ASICs), one or more field programmable gate arrays (FPGAs), one or more general purpose processors, or any combination thereof. Additionally, the memory 132 may include volatile memory, such as random access memory (RAM), and/or non-volatile memory, such as read-only memory (ROM), optical drives, hard disc drives, or solid-state drives.

The controller 130 may control operation of the first and second stages 108, 110 using, for example, a first actuator 136 and a second actuator 138, respectively. For example, the first actuator 136 may be a spring-return actuator configured to transition the first stage 108 between the first and second states. In certain embodiments, the staged damper system 100 may only include the first actuator 136 and not the second actuator 138, for example when the ABD of the second stage 110 operates entirely based on pressure.

Figure 7:
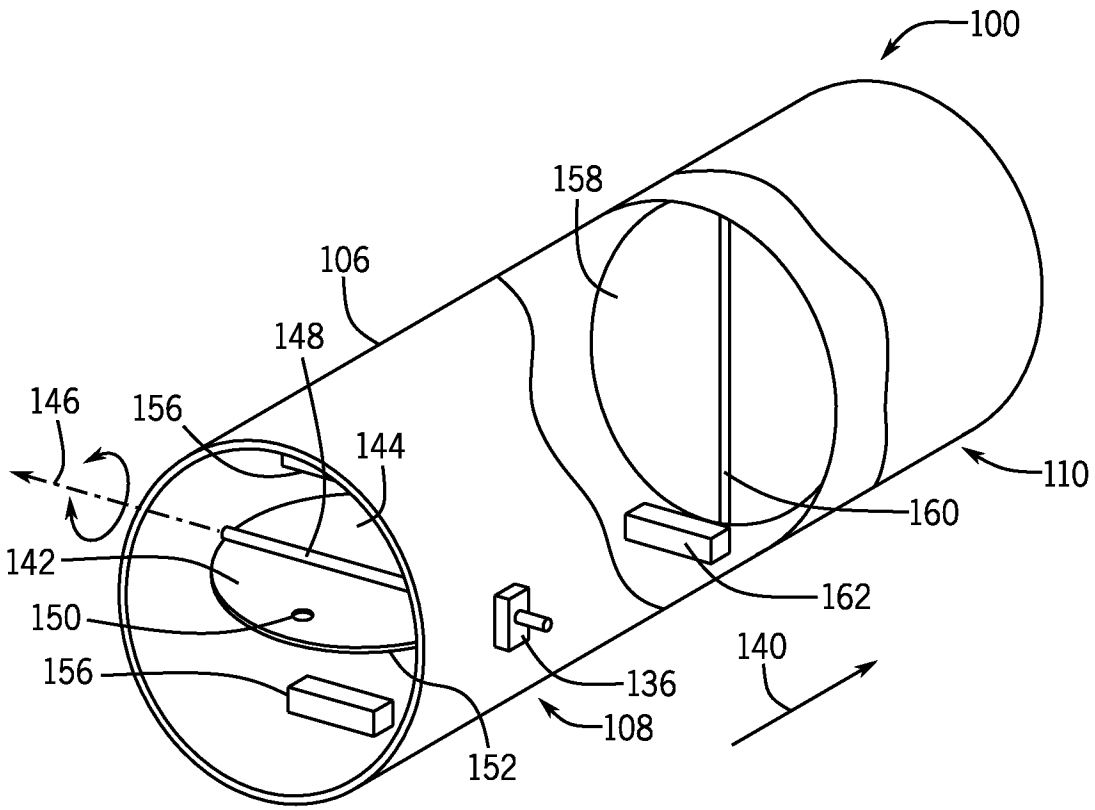
FIG. 7 is a cutaway perspective view of an embodiment of the staged damper system of FIG. 5, in accordance with an aspect the present disclosure.

FIG. 7 is a cutaway perspective view of the staged damper system 100. As illustrated, the staged damper system 100 includes an elongated, hollow member as the housing 106. The length of the housing 106 is positioned along an air flow direction 140 (e.g., substantially parallel with respect to the air flow direction 140). The first and second stages 108, 110 of the staged damper system 100, as illustrated, are formed by a combination of the housing 106 and various internal features positioned within the housing 106 along the air flow direction 140.

Specifically, the illustrated first stage 108 includes a damper blade 142 having a body 144 configured to rotate within the housing 106 about a rotational axis 146 orthogonal to the air flow direction 140. The rotational axis 146 is established by a shaft 148 rotatably securing the damper blade 142 to the housing 106. The shaft 148 is connected (e.g., at one end) to the first actuator 136, which may be a two-position spring return actuator. In such embodiments, the spring return actuator may be configured to maintain the damper blade 142 in a first position when not energized, and in a second position when energized. The first position corresponds to the first state of the first stage 108, where the body 144 of the damper blade 142 is oriented substantially orthogonally to the air flow direction 140, and the second position corresponds to the second state of the first stage 108, wherein the body 144 is oriented substantially parallel to the air flow direction 140. When the damper blade 142 is positioned orthogonally to the air flow direction 140, air flow through the housing 106 may be considered to be restricted, whereas when the damper blade 142 is positioned parallel to the air flow direction 140, air flow through the housing 106 may be considered to be unrestricted by the first stage 108. Thus, the first position may be considered a "closed" position of the first stage 108, and the second position may be considered an "open" position of the first stage 108.

As noted, the damper blade 142 is configured to substantially (but not completely) restrict air flow through the housing 106 when in its closed position. As illustrated, the damper blade 142 includes an orifice 150 configured to allow a certain amount of airflow to bypass the closed damper blade 142. The orifice 150 may be calibrated (e.g., sized) to allow a certain amount of airflow at certain pressures. The damper blade 142 also includes a damper seal 152 to ensure a tight shutoff between the damper blade 142 and an interior surface of the housing 106. In other words, the damper seal 152 ensures that when the damper blade is closed, the air flow is governed by the orifice 150. For example, the damper seal 154 fills gaps between the inner circumference of housing 106 and the outer circumference of damper blade 142 to block the air flow into those gaps. Additionally, there may be housing seals 156 within the housing 106. In one embodiment, the housing seals 156 are blocks disposed within housing 106 such that when damper blade 142 is in its closed position, the blocks at least partially conceal a region along the outer circumference of damper blade 142. This restricts air flowing through the gaps between the inner circumference of housing 106 and the outer circumference of damper blade 142 within that region.

As noted, the second stage 110 of the staged damper system 100 may include an automatic balancing damper (ABD) 158. The automatic balancing damper 158 is configured to rotate about a shaft 160 within the housing 106 to balance air flow through the housing 106. For example, the ABD 158 may regulate air flow through the housing 106 based on pressure. Thus, the ABD 158 may be configured to maintain a constant airflow volume through the housing 106, regardless of pressure changes. The ABD 158, for example, may include an airflow set point indicator 162 that dictates the airflow volume to be regulated by the ABD 158. Such automatic balancing dampers are available, for example, from Ruskin® of Kansas City, Mo.

Figure 8:
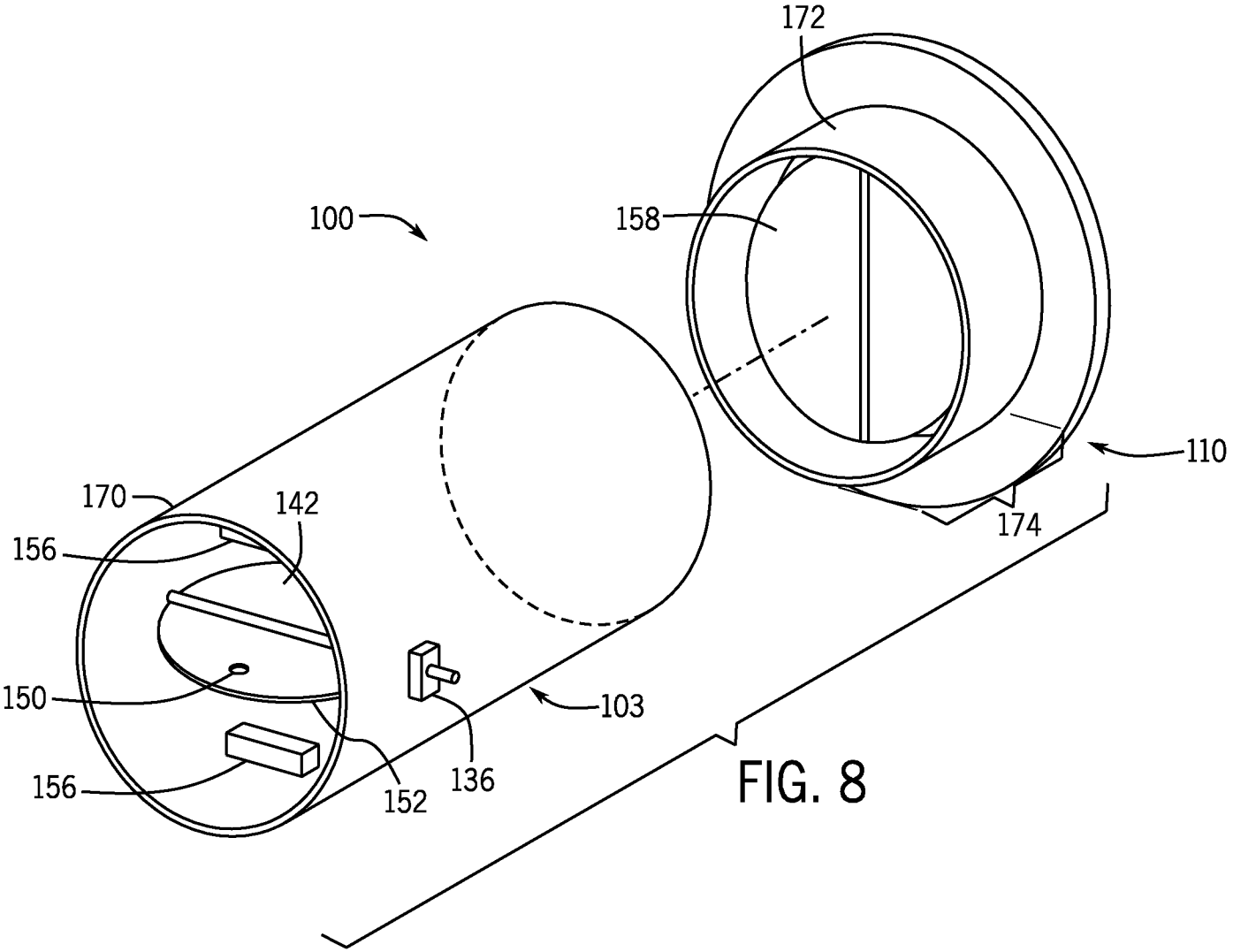
FIG. 8 is an exploded perspective view of another embodiment of the staged damper system of FIG. 5, in accordance with an aspect the present disclosure.

In certain embodiments, the staged damper system 100 may be modular. FIG. 8 is an exploded perspective view of such an embodiment. In particular, FIG. 8 illustrates an embodiment where the first stage 108 and the second stage 110 have separate respective housings 170, 172 that may be joined to form the housing 106 of the system 100. As shown, the first stage housing 170 houses the damper blade 142 along with damper blade seal 152 and the housing seals 156. The first actuator 136 is also attached to the first stage housing 170. In certain embodiments, the first stage housing 170 may include or be formed from metallic elements, such as aluminum, stainless steel, copper, or any combination thereof.

The second stage housing 172 houses at least the ABD 158, and may be formed from the same or different materials than the first stage housing 170. As an example, the second stage housing 172 may include or be formed from polymeric materials, such as a thermoplastic resin (e.g., acrylic, acrylonitrile butadiene styrene, or polyester). It is presently recognized that it may be desirable for the first and second stage housings 170, 172 to include different materials, as this provides a better connection therebetween to minimize airflow losses.

The first stage housing 170 and the second stage housing 172 may be joined in a number of ways, including via an interference fit, using fasteners, adhesives, and so forth. In the illustrated embodiment, the first and second stage housings 170, 172 fit together in an interference fit, where at least a portion of the second stage housing 172 (e.g., an insert portion 174) fits within the first stage housing 170. Accordingly, an outer perimeter (e.g., circumference) of the insert portion 174 may be matched in size to an inner perimeter (e.g., circumference) of the first stage housing 170. The two housings 170, 172 are coupled in such a manner that the damper blade 142 and the ABD 158 do not physically interfere with one another. Indeed, the damper blade 142 is only substantially controlled by the actuator 136, and the ABD 158 is automatic, with only a set point being input by a user.

Figure 9:
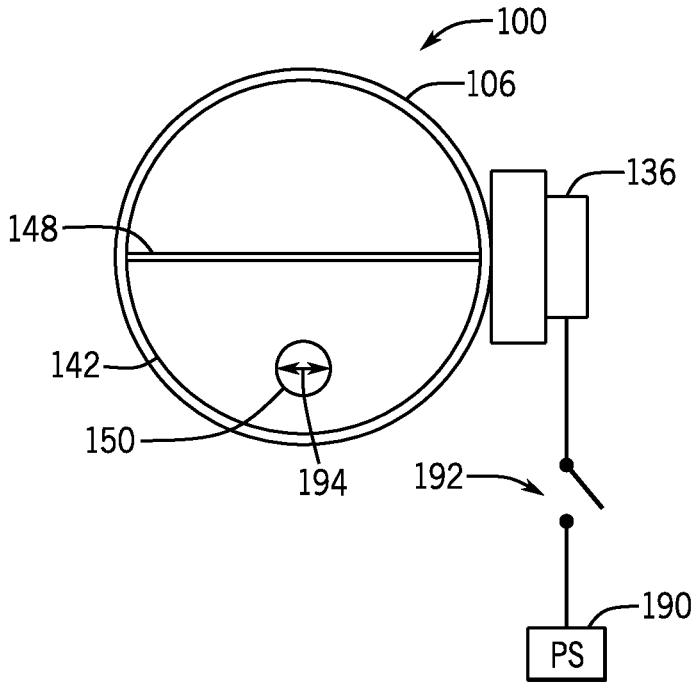
FIG. 9 is a front elevation view of an embodiment of the staged damper system of FIG. 5, in accordance with an aspect the present disclosure.

As noted above, the position of the damper blade 142 may be controlled relative to an indication of occupancy of a room, or similar indication. FIG. 9 is a front elevation view of the staged damper system 100 arrangement where the actuator 136 is configured to be energized by a power supply 190 to switch the damper blade 142 from the closed to the open position. In particular, the actuator 136 may be coupled and de-coupled to the power supply 190 via a switch 192. In certain embodiments, the power supply 190 may be a 120-volt alternating current provided by an electrical circuit. The electrical circuit may be similar to circuits generally used in home and commercial settings, and the switch 192 may be a light switch or similar switch that activates either automatically or in response to being flipped by an occupant. In other words, the power supply 190 may be received from closing of an electrical circuit performed by flipping the switch 192, which is generally intended to correspond to any similar act such as turning a knob, pulling a lever, pressing a button, or the like.

In the illustrated configuration, the actuator 136 is not connected to the power source 190 (the switch 192 is open). The actuator 136, having a spring return, maintains the damper blade 142 in the closed position such that only the orifice 150 allows air to bypass the damper blade 142. In the illustrated embodiment, the orifice 150 is calibrated to allow only a certain amount of airflow to bypass the damper blade 142, and is circular with a diameter 194 corresponding to the predetermined amount of airflow desired. However, the orifice 150 may be of any shape to allow air to flow through the damper blade 142. Further, the amount of air to flow through the orifice 150 may be based at least in part on standards requiring minimum ventilation, such as a static pressure of 1 inch water column within the air duct used for ventilation.

Figure 10:
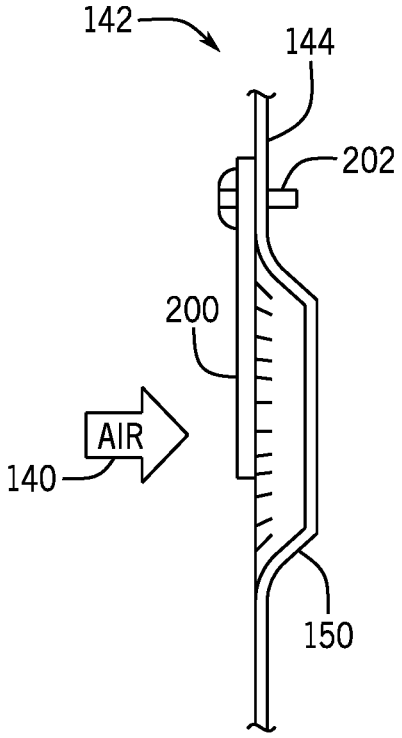
FIG. 10 is a side elevation view of an embodiment of a damper blade of the staged damper system having an orifice adjusting element, in accordance with an aspect of the present disclosure.

The minimum ventilation required for a conditioned space may be subject to relatively large variations across different regions and locations. For example, a hotel room, a restroom, a commercial showroom, and so forth, may all require different respective minimum ventilation levels. To provide for ventilation adjustability, the damper blade 142 may include features configured to adjust the amount of airflow through the orifice 150. FIG. 10 is a partial side elevation view of such an embodiment of the damper blade 142. Specifically, the illustrated damper blade 142 includes an orifice adjusting element 200, shown as a volume control disc, configured to control an amount of air flowing through the orifice 150. The orifice adjusting element 200 is secured to the body 144 of the damper blade 142 by a fastener 202, which also functions as a hinge to allow rotation of the orifice adjusting element 200 relative to the orifice 150. With this coupling, orifice adjusting element 200 is able to rotate 360° around the fastener 202 in a manner to allow varying amounts of the orifice 150 to be open to the airflow. It can also be seen in this view that the orifice 150 may be a calibrated extruded orifice that tapers in the airflow direction 140.

Figure 11:
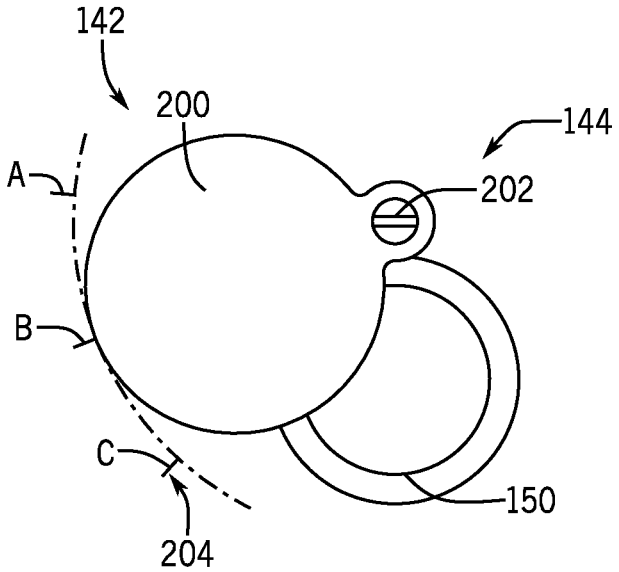
FIG. 11 is front elevation view of the damper blade of FIG. 10, in accordance with an aspect of the present disclosure.

The orifice adjusting element 200 may be moved to various positions that correspond to calibrated airflows at certain air pressures. As shown in FIG. 11, the damper blade 142 may also include an airflow volume setpoint indicator 204, which allows a user to select a volume setpoint for the orifice 150 using indicia on the element 200 and the body 144 of the damper blade 142 (shown as tic marks on the element 200 and the body 144) corresponding to various positions of the element 200 relative to the orifice 150. The volume setpoint indicator 204 may be calibrated to certain volumes at one or more pressures. As an example, the volume setpoint indicator 204 is set to position "B" in the illustrated embodiment, which corresponds to a certain airflow volume at a certain pressure. By way of non-limiting example, position "A" may correspond to 20 cubic feet per minute (cfm) at 0.5 inches of water column, position "B" may correspond to 15 cfm at 0.5 inches of water column, and position "C" may correspond to 12 cfm at 0.5 inches of water column. At other pressures, the airflow volume would be different at these positions.

Figure 12:
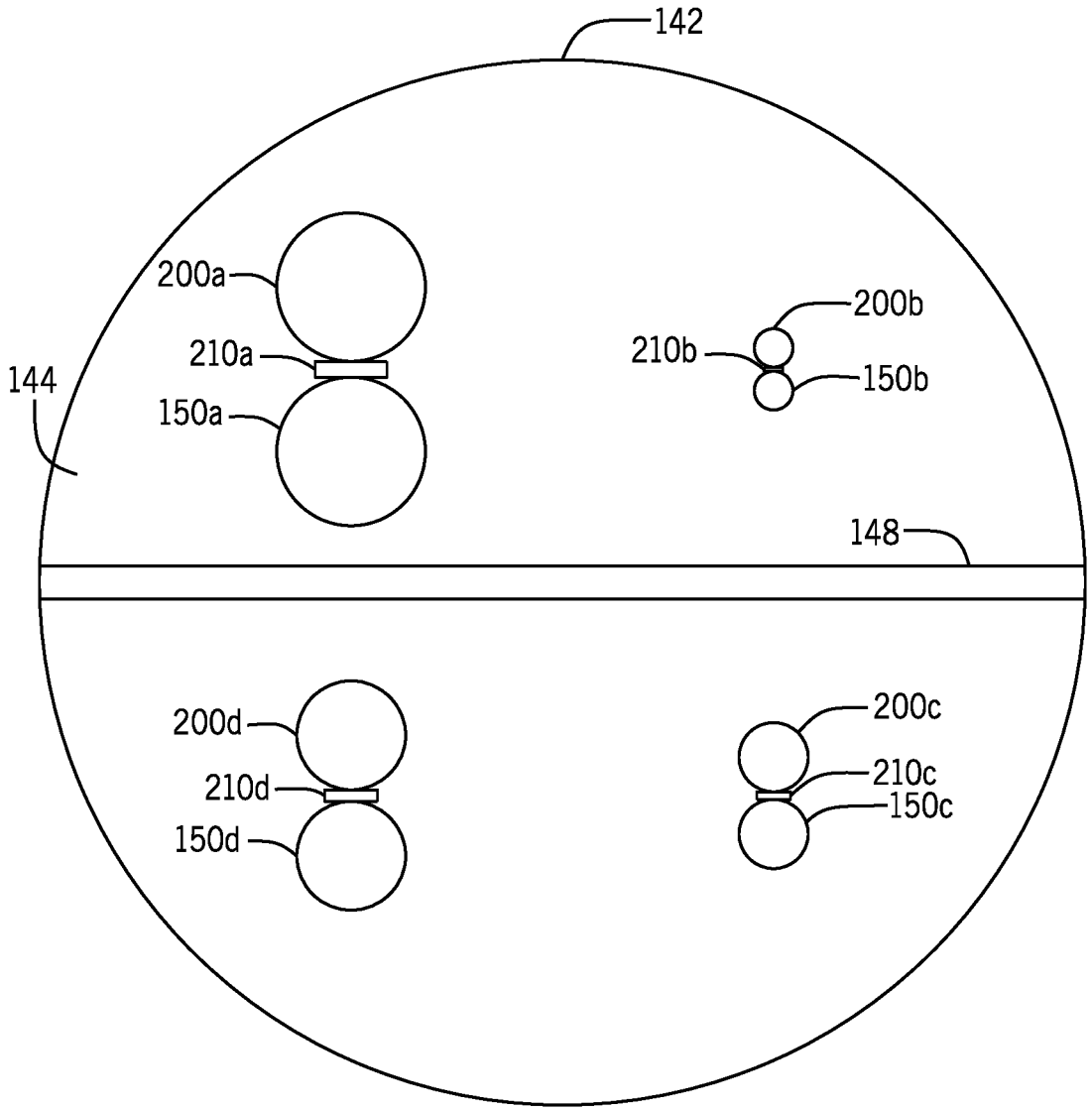
FIG. 12 is a front elevation view of another embodiment of the damper blade of the staged damper system, the damper blade having a plurality of orifices and a plurality of orifice adjusting elements, in accordance with an aspect the present disclosure.

FIG. 12 is a front elevation view of the damper blade 142 illustrating another embodiment of the orifice adjusting element 200. In the illustrated embodiment, the damper blade 142 includes a plurality of orifices 150*a*, 150*b*, 150*c*, and 150*d* that are capable of being selectively opened and closed to achieve various airflows. Each of the illustrated orifices 150 is coupled to a respective orifice adjusting element 200 via a corresponding hinge 210. The orifice adjusting element 200 is coupled in such a manner to rotate using hinge 210 such that it acts like a flip cap to cover orifice 150. As illustrated, each orifice 150 of the plurality of orifices may have a different size relative to other orifices. In FIG. 12, orifice 152*a* has the largest size, orifice 152*b* has the smallest size, and orifices 152*c* and 152*d* have intermediate sizes that are different from one another. Each orifice adjusting element 200 is capable of fully covering its respective orifice 150 to permit no air flow through that particular orifice.

Alternatively, the corresponding orifice adjusting element 200 can open and fully expose its respective orifice 150 to allow air flow through the entire corresponding orifice 150. Different combinations of the orifices 150 may be opened and closed to accommodate different ventilation levels. Additionally, although FIG. 12 illustrates four orifices 150, orifice adjusting elements 200, and hinges 210, there can be any number of orifices 150, orifice adjusting elements 200 and hinges 210 disposed on damper blade 142. The sizes, shapes, and locations of the orifices 150, orifice adjusting elements 200, and hinges 210 may also be different than that depicted in FIG. 12. For example, the orifice adjusting elements 200 may instead have configurations similar to that shown in FIGS. 10 and 11.

Figure 13:
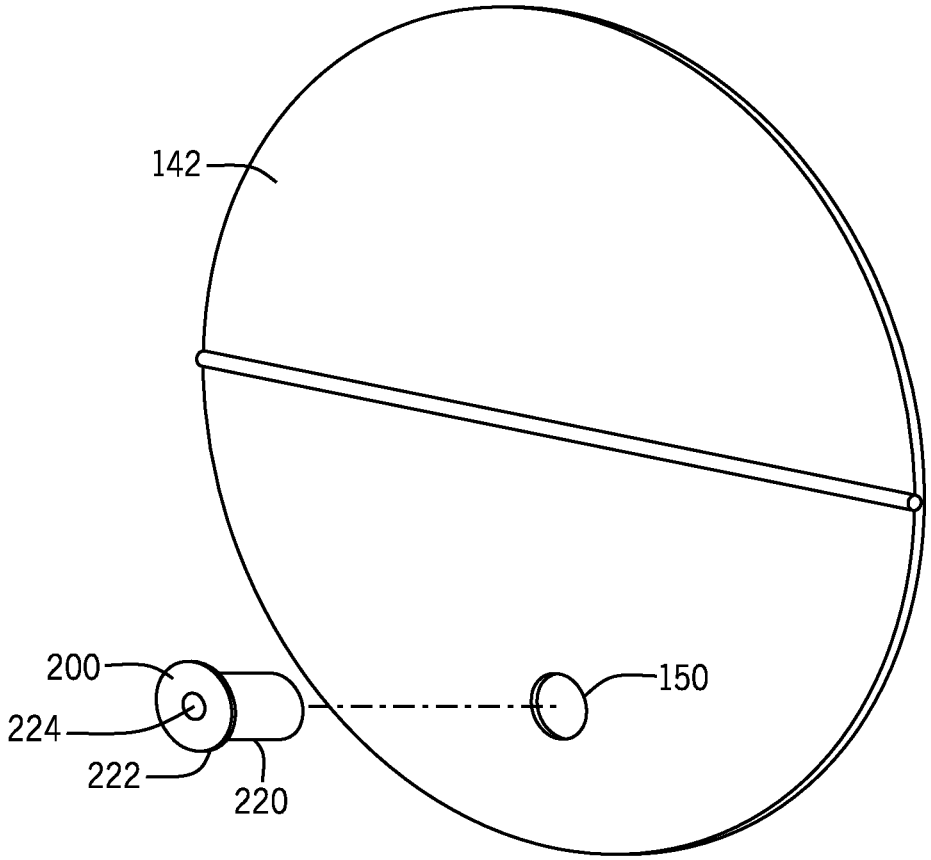
FIG. 13 is a perspective view of another embodiment of the damper blade of the staged damper system having an orifice and an orifice adjusting element, in accordance with an aspect the present disclosure.

FIG. 13 is a perspective view of the damper blade 142 and illustrating another embodiment of the orifice adjusting element 200. In the illustrated embodiment, the orifice adjusting element 200 is an insert having a base 220 that fits into the dimension of orifice 150. The orifice adjusting element 200 also includes a head 222 that is in contact with damper blade 142 when orifice adjusting element 200 is fully inserted. The head 222 may also contain elements configured to secure the orifice adjusting element 200 onto the damper blade 142 to prevent it from dislodging during operation of the staged damper system 100. The orifice adjusting element 200 may also contain an opening 224 extending through the entire orifice adjusting element 200 such that when fully inserted into the orifice 150, air will flow through the opening 224. The opening 224 may be smaller in area than the orifice 150 so that a different amount of air can flow through damper blade 142. There may also be multiple orifice adjusting elements 200 that can fit into the orifice 150, each with a different sized opening 224. Therefore, the air flowing through damper blade 142 can be adjusted to accommodate various levels of desired ventilation. Moreover, although FIG. 13 depicts the orifice 150 and the orifice adjusting element 200 each in a circular geometry, the shape of orifice 150 and orifice adjusting element 200 may have other shapes.

Figure 14:
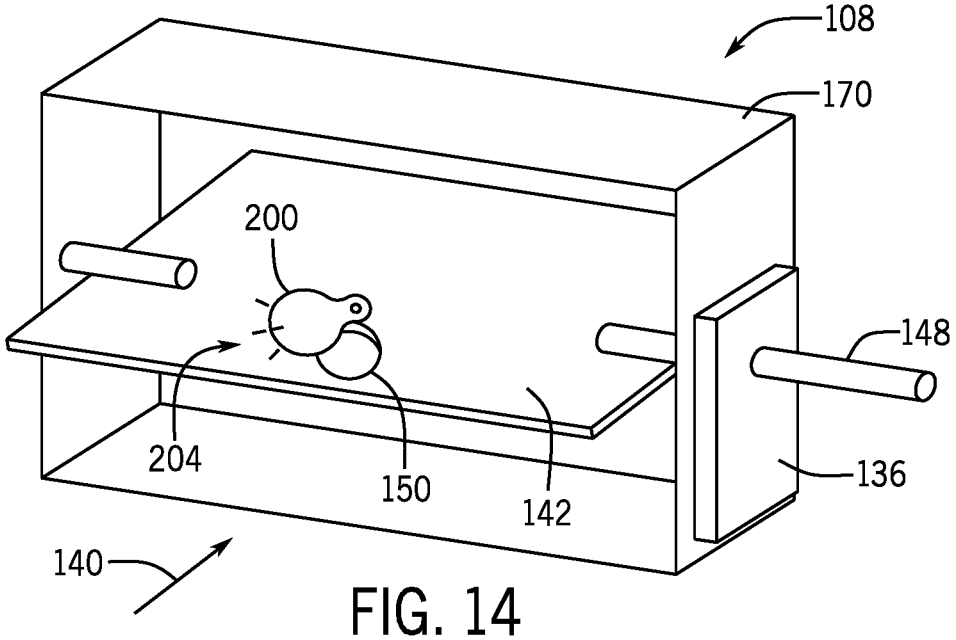
FIG. 14 is a perspective view of an embodiment of a first stage of the staged damper system having a rectangular geometry, in accordance with an aspect of the present disclosure.

In this respect, the shapes of a number of the features of the staged damper system 100 are not limited to being circular or annular. For example, FIG. 14 is a perspective view of an embodiment of the first stage 108 of the staged damper system 100 having a rectangular geometry. As shown, the first stage housing 170 (damper housing) and the damper blade 142 both have a rectangular cross-sectional geometry as seen from the airflow direction 140. Also shown in this embodiment are the orifice adjusting element 200 having the configuration shown in FIGS. 10 and 11.

As set forth above, the staged damper system of the present disclosure may provide one or more technical effects useful in the operation of HVAC systems to vary the air flow through a room based on the room's occupancy. For example, embodiments of the system may include in its first stage a damper blade that may seal the air duct to prevent most air flow through the air duct when the room is vacant. The damper blade may contain an orifice to allow for enough air flow through the system to satisfy standards requiring minimum ventilation into the room. An orifice adjusting element on the damper blade may change the amount of air flowing through the orifice to accommodate for different requirements of minimum ventilation. When the room becomes occupied, the damper blade opens to allow for more air flow through the air duct. Furthermore, when the room becomes occupied, there may be a desired amount of air to flow through the room. The system's second stage, an automatic balancing damper, adjusts its position to match the air flow through the duct with the desired air flowing through the room. As such, the system may adjust the amount of air flowing through the duct based on whether a room is vacant or occupied, then further match the amount of air flowing through the duct to a desired value when the room is occupied. The technical effects and technical problems in the specification are examples and are not limiting. It should be noted that the embodiments described in the specification may have other technical effects and can solve other technical problems.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A damper system comprising:

a damper housing configured to flow air;

a damper blade disposed in the damper housing and having an orifice and a disc coupled to the damper blade at a hinge point offset from a center of the disc, wherein the damper blade is rotatable in the damper housing between a closed position and an open position via a center pivot, wherein the orifice is configured to allow air to flow through the damper blade while the damper blade is in the closed position, and wherein the disc is configured to move along a surface of the damper blade and rotate about the hinge point to adjust an amount of the orifice exposed to the air; and an auto-balancing damper disposed in the damper housing apart from the damper blade, wherein the auto-balancing damper is configured to regulate a flow of the air through the damper housing.

2. The damper system of claim 1, comprising an actuator physically coupled to the damper blade and configured to move the damper blade between the closed position and the open position, and wherein the actuator, in response to receiving a power supply, is configured to adjust the damper blade to the open position.

3. The damper system of claim 2, wherein the actuator is coupled to the damper blade via a shaft extending through the damper housing and defining an axis of rotation for the damper blade to rotate between the closed position and the open position.

4. The damper system of claim 3, wherein the actuator is a spring return actuator such that in an absence of the power supply, the actuator allows the damper blade to return to the closed position.

5. The damper system of claim 1, wherein the auto-balancing damper and the damper blade are both disposed in the flow of the air.

6. The damper system of claim 5, wherein the auto-balancing damper is located downstream of the damper blade.

7. The damper system of claim 5, wherein the auto-balancing damper is located upstream of the damper blade.

8. The damper system of claim 1, wherein the orifice is offset from the center pivot.

9. The damper system of claim 1, wherein the damper housing comprises a seal configured to restrict air flow around the damper blade when the damper blade is in the closed position.

10. The damper system of claim 1, comprising a seal disposed around a perimeter of the damper blade, wherein the seal is configured to block the flow of the air around the perimeter of the damper blade when the damper blade is in the closed position.

11. The damper system of claim 1, wherein the auto-balancing damper comprises a second damper blade configured to rotate within the damper housing to regulate the flow of the air through the damper system.

12. The damper system of claim 1, wherein the auto-balancing damper comprises an auto-balancing damper housing positioned at least partially within the damper housing.

13. The damper system of claim 12, wherein the auto-balancing damper housing is secured within the damper housing via an interference fit.

14. The damper system of claim 12, wherein the auto-balancing damper housing and the damper housing are made from different materials.

15. The damper system of claim 1, wherein the damper system is part of a ventilation system.

16. A damper system, comprising:

a damper housing configured to flow ventilation air through a first stage and a second stage of the damper system, wherein the first stage is configured to allow turndown of a flow rate of the ventilation air, and wherein the second stage is configured to maintain a setpoint for the flow rate of the ventilation air and is disposed downstream of the first stage;

a damper blade of the first stage disposed in the damper housing and having an orifice and a flap rotatably coupled to the damper blade about a hinge point offset from a center of the damper blade, wherein the damper blade is rotatable in the damper housing via a shaft extending through a center portion of the damper housing to switch between a closed position and an open position, wherein, in the open position, the damper blade extends in an upstream direction and in a downstream direction relative to flow of the ventilation air through the damper housing, wherein the orifice is configured to allow the ventilation air to flow through the damper blade while the damper blade is in the closed position, and wherein the flap is configured to rotate along the damper blade about the hinge point to adjust an amount of the ventilation air flowing through the orifice; and an actuator physically coupled to the damper blade via the shaft and configured to rotate the damper blade between the closed position and the open position, and wherein the actuator, in response to receiving a power supply, is configured to adjust the damper blade to the open position.

17. The damper system of claim 16, wherein the actuator is a spring return actuator such that in an absence of the power supply, the actuator allows the damper blade to return to the closed position.

18. The damper system of claim 16, wherein the closed position restricts flow of the ventilation air around the damper blade via seals disposed along the outer circumference of the damper blade.

19. The damper system of claim 16, wherein the damper blade comprises a plurality of orifices that comprises the orifice.

20. The damper system of claim 16, wherein the actuator is electrically coupled to a circuit, and the actuator receives the power supply via closing of the circuit.

21. A damper system, comprising:

a housing configured to flow ventilation air through a first stage and a second stage of the damper system, wherein the first stage is configured to allow turndown of a flow rate of the ventilation air, wherein the second stage is configured to maintain a setpoint for the flow rate of the ventilation air and is disposed downstream of the first stage, and wherein the housing comprises an annular geometry;

a damper blade of the first stage disposed in the housing and having an orifice, wherein the damper blade is rotatable in the housing via a shaft extending through the housing to switch between a closed position and an open position, and wherein the orifice is configured to allow the ventilation air to flow through the damper blade while the damper blade is in the closed position; and an orifice adjusting element coupled to the damper blade proximate the orifice and via a hinge point offset from a center of the orifice adjusting element, wherein the orifice adjusting element is configured to rotate about the hinge point in a direction parallel to a plane of the damper blade to cover all or a portion of the orifice to control an amount of the ventilation air flowing through the orifice.

22. The damper system of claim 21, wherein the damper blade comprises a calibrated volume indicator configured to align with indicia on the orifice adjusting element at various rotational positions of the orifice adjusting element, wherein the calibrated volume indicator provides an indication of air flow volume allowed to pass through the orifice at a particular air pressure at a particular rotational position of the orifice adjusting element.

23. The damper system of claim 21, wherein the orifice adjusting element is a disk rotatably secured to the damper blade.

* * * * *